US011176904B2

(12) United States Patent
Xing et al.

(10) Patent No.: US 11,176,904 B2
(45) Date of Patent: Nov. 16, 2021

(54) SOURCE DRIVING CIRCUIT, DRIVING METHOD AND DISPLAY DEVICE FOR DECREASING COLOR SHIFT IN LARGE VIEWING ANGLE

(71) Applicants: Hefei Xinsheng Optoelectronics Technology Co., Ltd., Hefei (CN); BOE TECHNOLOGY GROUP CO., LTD., Beijing (CN)

(72) Inventors: Zhenzhou Xing, Beijing (CN); Jianjun Wang, Beijing (CN); Hui Dong, Beijing (CN); Xiaoshi Liu, Beijing (CN); Zejun Chen, Beijing (CN)

(73) Assignees: Hefei Xinsheng Optoelectronics Technology Co., Ltd., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/007,081

(22) Filed: Aug. 31, 2020

(65) Prior Publication Data

US 2021/0193073 A1 Jun. 24, 2021

(30) Foreign Application Priority Data

Dec. 18, 2019 (CN) ..... 201911309676.8

(51) Int. Cl.
*G09G 3/36* (2006.01)

(52) U.S. Cl.
CPC ..... *G09G 3/3688* (2013.01); *G09G 3/3696* (2013.01); *G09G 2300/0465* (2013.01); *G09G 2310/027* (2013.01); *G09G 2310/0286* (2013.01); *G09G 2310/0291* (2013.01); *G09G 2320/0242* (2013.01); *G09G 2360/18* (2013.01)

(58) Field of Classification Search
CPC ..... G09G 3/36; G09G 3/3622; G09G 3/3625; G09G 3/364; G09G 3/3685; G09G 3/3688; G09G 3/3692; G09G 2310/0286; G09G 2310/0289; G09G 2310/0291; G09G 2320/0242; G09G 2360/18
USPC ..... 345/87–104
See application file for complete search history.

(56) References Cited

U.S. PATENT DOCUMENTS 10,417,987 B2 * 9/2019 Xing ..... G09G 3/3677
2007/0195047 A1 * 8/2007 Cho ..... G09G 3/3648 345/98

(Continued)

*Primary Examiner* — Alexander Eisen
*Assistant Examiner* — Nelson Lam
(74) *Attorney, Agent, or Firm* — Thomas | Horstemeyer, LLP

(57) ABSTRACT

The present disclosure provides a source driving circuit, a driving method, and a display device. The source driving circuit includes a gamma generating circuit, a gamma regulating circuit, and a control circuit. The gamma regulating circuit is configured to determine, according to a plurality of gamma reference voltage pairs, a first output voltage, a second output voltage, a third output voltage, and a fourth output voltage corresponding to each of the gamma reference voltage pairs. Further, the control circuit is configured to perform driving and displaying with the first output voltage in a first image frame, with the second output voltage in a second image frame, with the third output voltage in a third image frame, and with the fourth output voltage in a fourth image frame.

17 Claims, 4 Drawing Sheets

(56) References Cited

U.S. PATENT DOCUMENTS

| | | | | |
|---|---|---|---|---|
| 2008/0129673 | A1* | 6/2008 | Kim | G09G 3/3648 345/89 |
| 2015/0170609 | A1* | 6/2015 | Jung | G09G 3/20 345/212 |
| 2016/0117991 | A1* | 4/2016 | Ha | G09G 3/3233 345/78 |
| 2016/0247451 | A1* | 8/2016 | Kim | G09G 3/3233 |
| 2016/0365020 | A1* | 12/2016 | Kim | G09G 3/20 |
| 2017/0053612 | A1* | 2/2017 | Shin | G09G 3/3614 |
| 2018/0211602 | A1* | 7/2018 | Cho | G09G 3/3258 |
| 2020/0035173 | A1* | 1/2020 | Kim | G09G 3/3607 |

* cited by examiner

SOURCE DRIVING CIRCUIT, DRIVING METHOD AND DISPLAY DEVICE FOR DECREASING COLOR SHIFT IN LARGE VIEWING ANGLE

CROSS-REFERENCE TO RELATED APPLICATION

This application is based upon and claims priority to Chinese Patent Application No. 201911309676.8 filed on Dec. 18, 2019, the entire contents thereof are incorporated herein by reference.

TECHNICAL FIELD

The present disclosure relates to the field of display technology and, in particular, to a source driving circuit, a driving method and a display device.

BACKGROUND

Liquid crystal displays (LCDs) are still popular in the market. However, there is an inherent defect in the LCD, that is, when being viewed at a large viewing angle, the LCD may suffer a phenomenon of color shift since an optical brightness curve thereof cannot meet Gamma 2.2. Further, the larger the viewing angle, the more serious the color shift. As shown in FIG. 1, when human eyes view a LCD pane at the viewing angles of 0 degree, 30 degree and 45 degree respectively, the brightness viewed is not the same, that is, the greater the viewing angle, the greater a brightness shift.

At present, a pixel design for multi-domain display is generally employed in order to solve the problem of the color shift in a large viewing angle. That is, RGB pixels are divided into a main area and a sub-area, and different thin film transistor (TFT) control circuits are used to control rotation of liquid crystal molecules in the main area and the sub-area, thereby mixedly compensating the Gamma curve in the large viewing angle so as to decrease the color shift. However, in such control method, the TFT pixel control circuit is so complex that aperture ratio of pixel and yield rate are reduced.

SUMMARY

The present disclosure provides a source driving circuit, a driving method, and a display device that decrease a color shift in a large viewing angle in the related art, to overcome the problem that a complexity of a pixel control circuit is increased when decreasing the color shift in the large viewing angle in the related art, and to reduce a aperture ratio of pixel.

An embodiment of the present disclosure provides a source driving circuit, including a gamma generating circuit, a gamma regulating circuit, and a control circuit. The gamma generating circuit is configured to generate a plurality of gamma reference voltage pairs, and each of the gamma reference voltage pairs includes a positive gamma reference voltage and a negative gamma reference voltage having equal absolute values; the gamma regulating circuit is configured to determine, according to the plurality of gamma reference voltage pairs and a compensation voltage, a first output voltage, a second output voltage, a third output voltage, and a fourth output voltage corresponding to each of the gamma reference voltage pairs; and the control circuit is configured to perform driving and displaying with the first output voltage in a first image frame, with the second output voltage in a second image frame, with the third output voltage in a third image frame, and with the fourth output voltage in a fourth image frame, wherein the first image frame, the second image frame, the third image frame and the fourth image frame are four adjacent image frames in a display process.

In a possible implementation, the gamma regulating circuit is specifically configured to acquire, according to the gamma reference voltage pairs, the compensation voltage which is pre-stored, and determine, according to the gamma reference voltage pairs and the compensation voltage, the first output voltage, the second output voltage, the third output voltage, and the fourth output voltage corresponding to each of the gamma reference voltage pairs. The first output voltage is equal to a sum of the positive gamma reference voltage and the compensation voltage, the second output voltage is equal to a difference between the negative gamma reference voltage and the compensation voltage, the third output voltage is equal to a difference of the positive gamma reference voltage and the compensation voltage, and the fourth output voltage is equal to a sum of the negative gamma reference voltage and the compensation voltage.

In a possible implementation, the source driving circuit further includes a storage circuit, and the storage circuit is configured to store the compensation voltage before the gamma regulating circuit determines the first output voltage, the second output voltage, the third output voltage, and the fourth output voltage.

In a possible implementation, the compensation voltage is 0 V to 0.2 V.

In a possible implementation, the source driving circuit further includes: a bidirectional shift register circuit, a potential conversion circuit, a digital-to-analog conversion circuit, and an output buffer circuit. The bidirectional shift register circuit is configured to buffer received video data; the potential conversion circuit is configured to raise a voltage of the video data according to the video data buffered by the bidirectional shift register circuit; the digital-to-analog conversion circuit is configured to receive the first output voltage, the second output voltage, the third output voltage, and the fourth output voltage output by the control circuit, and control, according to the raised voltage of the video data, the first output voltage, the second output voltage, the third output voltage, and the fourth output voltage to be output to the output buffer circuit; and the output buffer circuit is configured to generate a plurality of branch voltages according to the first output voltage, the second output voltage, the third output voltage, and the fourth output voltage.

An embodiment of the present disclosure further provides a driving method of the driving circuit as provided by the embodiment of the present disclosure, including: generating a plurality of gamma reference voltage pairs; determining, according to the plurality of gamma reference voltage pairs and a compensation voltage, a first output voltage, a second output voltage, a third output voltage, and a fourth output voltage corresponding to each of the gamma reference voltage pairs; and performing driving and displaying with the first output voltage in a first image frame, with the second output voltage in a second image frame, with the third output voltage in a third image frame, and with the fourth output voltage in a fourth image frame.

In a possible implementation, determining, according to the plurality of gamma reference voltage pairs and the compensation voltage, the first output voltage, the second output voltage, the third output voltage, and the fourth output voltage corresponding to each of the gamma reference voltage pairs, includes: acquiring, according to the gamma reference voltage pairs, the compensation voltage which is pre-stored; and determining, according to the gamma reference voltage pairs and the compensation voltage, the first output voltage, the second output voltage, the third output voltage, and the fourth output voltage corresponding to each of the gamma reference voltage pairs.

In a possible implementation, the driving method further includes, before determining the first output voltage, the second output voltage, the third output voltage, and the fourth output voltage: storing the compensation voltage.

In a possible implementation, the driving method further includes, before determining the first output voltage, the second output voltage, the third output voltage, and the fourth output voltage corresponding to each of the gamma reference voltage pairs: receiving and buffering video data; and raising a voltage of the video data according to the video data buffered. The driving method further includes, before determining the first output voltage, the second output voltage, the third output voltage, and the fourth output voltage corresponding to each of the gamma reference voltage pairs: controlling, according to the raised voltage of the video data, the first output voltage, the second output voltage, the third output voltage, and the fourth output voltage to be output; and generating a plurality of branch voltages according to the first output voltage, the second output voltage, the third output voltage, and the fourth output voltage which are output.

An embodiment of the present disclosure further provides a display device, including the source driving circuit as provided by the embodiment of the present disclosure.

The embodiments of the present disclosure have the following beneficial effects:

The source driving circuit provided by the embodiment of the present disclosure includes the gamma generating circuit, the gamma regulating circuit, and the control circuit. The gamma regulating circuit is configured to determine, according to the plurality of gamma reference voltage pairs, the first output voltage, the second output voltage, the third output voltage, and the fourth output voltage corresponding to each of the gamma reference voltage pairs; and the control circuit is configured to perform driving and displaying with the first output voltage in the first image frame, with the second output voltage in the second image frame, with the third output voltage in the third image frame, and with the fourth output voltage in the fourth image frame. That is, in the embodiment of the present disclosure, a corresponding brightness curve during the time period of the first image frame and the second image frame is closer to a corresponding brightness curve in a large viewing angle. During the third image frame and the fourth image frame, the compensation voltage is subtracted from the absolute values of the positive gamma reference voltage and the negative gamma reference voltage respectively, that is, a driving is performed with $+(Vr-\beta)$ and $-(Vr-\beta)$, and a corresponding brightness curve during this time period is closer to a corresponding brightness curve in a vertical viewing angle. During a continuous viewing process, since there is a vision persistence effect of human eyes, what the human eyes see is a neutralized curve, that is, the brightness curve actually viewed is closer to an ideal curve, which can decrease a color shift in a large viewing angle. In addition, compared with the related art in which different pixel circuits are used to decrease the color shift in the large viewing angle, the source drive circuit provided by the embodiment of the present disclosure has a less complicated pixel driving circuit, which can overcome the problem that the complexity of the pixel control circuit is increased for decreasing the color shift in the large viewing angle in the related art, and thus can reduce a aperture ratio of pixel.

DETAILED DESCRIPTION

In order to make the objectives, technical solutions, and advantages of the embodiments of the present disclosure clearer, the technical solutions of the embodiments of the present disclosure will be described clearly and completely in conjunction with the accompanying drawings of the embodiments of the present disclosure. Understandably, the described embodiments are part of the embodiments of the present disclosure, rather than all the embodiments. Based on the described embodiments of the present disclosure, all other embodiments obtained by those skilled in the art without creative efforts are within the protection scope of the present disclosure.

Unless otherwise defined, technical terms or scientific terms used in the present disclosure shall have common meanings understood by those skilled in the field to which the present disclosure belongs. Terms "first," "second," or the like used in the present disclosure do not indicate any order, quantity, or importance, but are only used to distinguish different components from each other. Terms "include," "comprise," or the like mean that an element or item appearing before the term encompasses an element or item listed after the term and equivalents thereof, but does not exclude other elements or items. Terms "connect," "couple," or the like are not limited to physical or mechanical connections, but may include electrical connections, regardless of direct or indirect connections. Terms "on," "under," "left," "right," and the like are only used to indicate a relative position. When an absolute position of a described object changes, the relative position thereof may also change accordingly.

In order to make the following description of the embodiments of the present disclosure clear and concise, detailed descriptions of known functions and components are omitted in the present disclosure.

Figure 1:
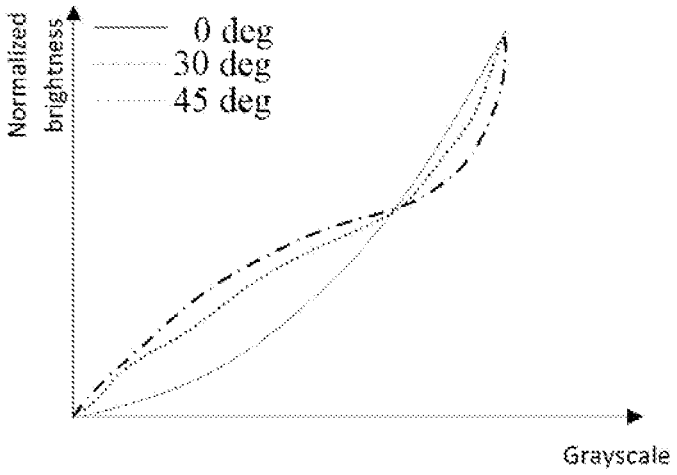
Prior Art FIG. 1
FIG. 1 is a schematic diagram of a gamma curve of a liquid crystal display panel in the prior art when being viewed from different angles.
Figure 2:
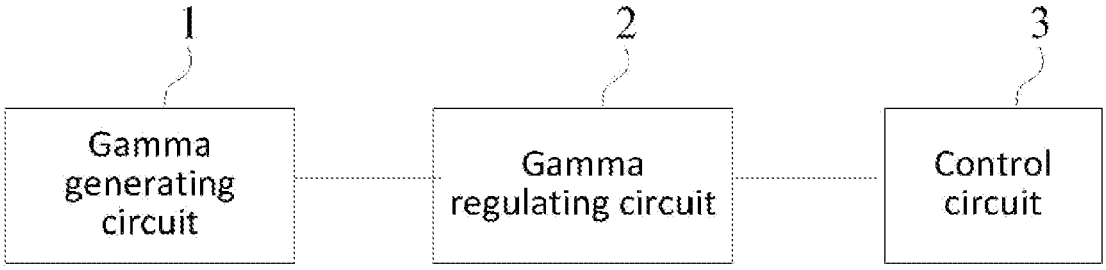
FIG. 2 is a schematic structural diagram of a source driving circuit provided by an embodiment of the present disclosure.

Referring to FIG. 2, an embodiment of the present disclosure provides a source driving circuit, including: a gamma generating circuit 1, a gamma regulating circuit 2, and a control circuit 3.

The gamma generating circuit 1 is configured to generate a plurality of gamma reference voltage pairs, each of the gamma reference voltage pairs includes a positive gamma reference voltage which is positive and a negative gamma reference voltage which is negative, and the positive gamma reference voltage and negative gamma reference voltage have equal absolute values. That is, for example, the gamma generating circuit can generate 5 gamma reference voltage pairs, which can be respectively: a first gamma reference voltage pair +Vr1/−Vr1 (including the positive gamma reference voltage +Vr1 and the negative gamma reference voltage −Vr1, which have equal absolute values), a second gamma reference voltage pair +Vr2/−Vr2 (including the positive gamma reference voltage +Vr2 and the negative gamma reference voltage −Vr2, which have equal absolute values), a third gamma reference voltage pair +Vr3/−Vr3 (including the positive gamma reference voltage +Vr3 and the negative gamma reference voltage −Vr3, which have equal absolute values), a fourth gamma reference voltage pair +Vr4/−Vr4 (including the positive gamma reference voltage +Vr4 and the negative gamma reference voltage −Vr4, which have equal absolute values), and a fifth gamma reference voltage pair +Vr5/−Vr5 (including the positive gamma reference voltage +Vr5 and the negative gamma reference voltage −Vr5, which have equal absolute values). It should be noted that it is only an example that the gamma generating circuit can generate 5 gamma reference voltage pairs. In specific implementation, the gamma generating circuit can also generate other number of gamma reference voltage pairs, which is not limited in the present disclosure. Of course, for numerical simulation points of a gamma curve, the large the number of points is, the more accurate it is. In addition, for one image frame, there is only one gamma curve, and the plurality of gamma reference voltage pairs here are taken from the same gamma curve.

The gamma regulating circuit 2 is configured to determine, according to the plurality of gamma reference voltage pairs, a first output voltage, a second output voltage, a third output voltage, and a fourth output voltage corresponding to each of the gamma reference voltage pairs. The first output voltage is equal to a sum of the positive gamma reference voltage and a compensation voltage β, the second output voltage is equal to a difference between the negative gamma reference voltage and the compensation voltage β, the third output voltage is equal to a difference of the positive gamma reference voltage and the compensation voltage β, and the fourth output voltage is equal to a sum of the negative gamma reference voltage and the compensation voltage β. That is, for example, for the first gamma reference voltage pair +Vr1/−Vr1, the first output voltage is +(Vr1+β), the second output voltage is −(Vr1+β), the third output voltage is +(Vr1−β), and the fourth output voltage is −(Vr1−β); for the second gamma reference voltage pair +Vr2/−Vr2, the first output voltage is +(Vr2+β), the second output voltage is −(Vr2+β), the third output voltage is +(Vr2−β), and the fourth output voltage is −(Vr2−β)); for the third gamma reference voltage pair +Vr3/−Vr3, the first output voltage is +(Vr3+β), the second output voltage is −(Vr3+β), the third output voltage is +(Vr3−β), and the fourth output voltage is −(Vr3−β); for the fourth gamma reference voltage pair +Vr4/−Vr4, the first output voltage is +(Vr4+β), the second output voltage is −(Vr4+β), the third output voltage is +(Vr4−β), and the fourth output voltage is −(Vr4−β); and for the fifth gamma reference voltage pair +Vr5/−Vr5, the first output voltage is +(Vr5+β), the second output voltage is −(Vr5+β), the third output voltage is +(Vr5−β), and the fourth output voltage is −(Vr5β).

The control circuit 3 is configured to perform driving and displaying with the first output voltage in a first image frame, with the second output voltage in a second image frame, with the third output voltage in a third image frame, and with the fourth output voltage in a fourth image frame, wherein the first image frame, the second image frame, the third image frame and the fourth image frame are four adjacent image frames in a display process. That is, for example, the driving and displaying are performed with +(Vr1+β), +(Vr2+β), +(Vr3+β), +(Vr4+β), +(Vr5+β) in the first image frame; with −(Vr1+β), −(Vr2+β), −(Vr3+β), −(Vr4+β), −(Vr5+β) in the second image frame; with +(Vr1−β), +(Vr2−β), +(Vr3−β), +(Vr4−β), +(Vr5−β) in the third image frame; and with −(Vr1−β), −(Vr2−β), −(Vr3−β), −(Vr4−β), −(Vr5−β) in the fourth image frame.

Figure 3:
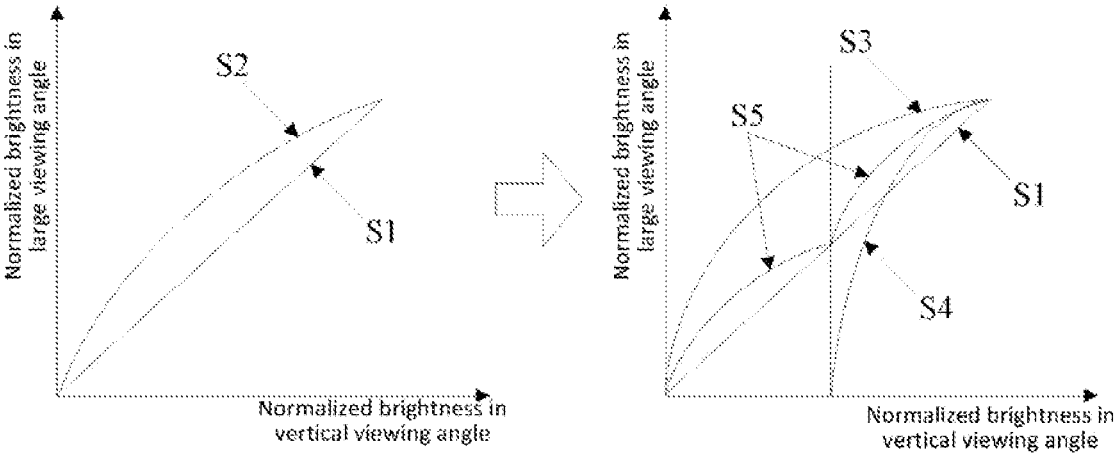
FIG. 3 is a schematic diagram of a mixed compensation effect curve of an embodiment of the present disclosure.

The source driving circuit provided by the embodiment of the present disclosure includes the gamma generating circuit, the gamma regulating circuit, and the control circuit. The gamma regulating circuit is configured to determine, according to the plurality of gamma reference voltage pairs, the first output voltage, the second output voltage, the third output voltage, and the fourth output voltage corresponding to each of the gamma reference voltage pairs; and the control circuit is configured to perform driving and displaying with the first output voltage in the first image frame, with the second output voltage in the second image frame, with the third output voltage in the third image frame, and with the fourth output voltage in the fourth image frame. That is, since the display brightness of a liquid crystal display panel is determined by controlling rotation of liquid crystal molecules and thus light transmittance through a voltage, when the liquid crystal display panel is viewed from different angles at the same time, the angle of the liquid crystal molecule is different, that is, the brightness is also different. As shown in FIG. 3, and referring to an ideal straight line S1 in the left figure in FIG. 3, that is, the brightness of an ideal liquid crystal display panel viewed at a large viewing angle is the same as that viewed at a vertical viewing angle. However, referring to an actual viewing curve S2 in the left figure in FIG. 3, due to the inherent defect of the liquid crystal display panel, the brightness viewed at a large viewing angle is different from that viewed at a vertical viewing angle. In the embodiment of the present disclosure, during the first image frame and the second image frame, the compensation voltage is added to the absolute values of the positive gamma reference voltage and the negative gamma reference voltage respectively, that is, a driving is performed with +(Vr+β) and −(Vr+β), and a corresponding brightness curve during this time period is closer to a corresponding brightness curve in a large viewing angle (i.e., S3 in the right figure in FIG. 3). During the third image frame and the fourth image frame, the compensation voltage is subtracted from the absolute values of the positive gamma reference voltage and the negative gamma reference voltage respectively, that is, the driving is performed with +(Vr−β) and −(Vr−β), and a corresponding brightness curve during this time period is closer to a corresponding brightness curve in a vertical viewing angle (i.e., S4 in the right figure in FIG. 3). During a continuous viewing process, since there is a vision persistence effect of human eyes, what the human eyes see is a neutralized curve (i.e., S5 in the right figure in FIG. 3), that is, the brightness curve actually viewed is closer to an ideal curve S1, which can decrease a color shift in a large viewing angle. At the same time, since two adjacent frames are driven respectively by positive and negative voltage differences that are equal, there are no problems such as residual charges and liquid crystal polarization. Further, compared with the related art in which different pixel circuits are used to decrease the color shift in the large viewing angle, the source drive circuit provided by the embodiment of the present disclosure has a less complicated pixel driving circuit, which can overcome the problem that the complexity of the pixel control circuit is increased for decreasing the color shift in the large viewing angle in the related art, and thus can reduce a aperture ratio of pixel.

It should be noted that the gamma reference voltages output during the first/second image frames are +(Vr1+β), . . . , +(Vr5+β), −(Vr1+β), . . . , +(Vr5+β). Compared with the gamma reference voltages +Vr1, . . . , +Vr5, −Vr1, . . . , −Vr5 output during the first/second image frames in the related art, if the compensation voltage β is +0.05 V, the gamma curve in the embodiment of the present disclosure should have a value of about 2.2~2.3, which meets a general rule of gamma curve 2.2±0.2. Similarly, the gamma reference voltages output during the third/fourth image frames are +(Vr1−β), . . . , +(Vr5−β), −(Vr1−β), . . . , −(Vr5−β), and compared with the gamma reference voltages +Vr1, . . . , +Vr5, −Vr1, . . . , −Vr5 output during the first/second image frames in the related art, if the compensation voltage β is −0.05 V, the gamma curve should have a value of about 2.1~2.2, which also meets the general rule of gamma curve 2.2±0.2. In consideration of the vision persistence effect of human eyes, when a refresh frequency is greater than 30 Hz, the human eyes cannot observe a change, so that the display effect is not much affected for the vertical viewing angle, and the affect is negligible.

In addition, it is understood that the liquid crystal display panel shall be driven with positive and negative voltages, and shall be driven by equal voltage differences (to prevent charge remaining), so the first and second image frames shall be continuous. During the first and second image frames, the compensation voltage β is added to the initial gamma reference voltage, and in order to balance the brightness, the third/fourth image frames (during which, the compensation voltage β is subtracted from the initial gamma reference voltage) follows the first/second image frames.

In a specific implementation, the gamma regulating circuit 2 is specifically configured to acquire, according to the gamma reference voltage pairs, the compensation voltage β which is pre-stored, and determine, according to the gamma reference voltage pairs and the compensation voltage β, the first output voltage, the second output voltage, the third output voltage, and the fourth output voltage corresponding to each of the gamma reference voltage pairs. Correspondingly, in a specific implementation, referring to FIG. 4, the source driving circuit further includes a storage circuit 4, and the storage circuit 4 is configured to store the compensation voltage before the gamma regulating circuit 2 determines the first output voltage, the second output voltage, the third output voltage, and the fourth output voltage. Specifically, the compensation voltage may be 0V to 0.2V, and further, optionally, the compensation voltage may be 0V to 0.59 V.

In a specific implementation, the storage circuit 4 can be a read-only memory (ROM) in the source driving circuit, in which the following Table 1 may be stored. The "row" and "column" in Table 1 can be used to identify the address of a storage unit. When data is stored in a particular storage unit, the row and column corresponding to the storage unit is found to find the storage unit, and then a value is burned into the storage unit. Similarly, when the data is read from the particular storage unit, the row and column corresponding to the storage unit is found, and the corresponding data is read from the storage unit.

The value of β may be 0.05V, 0.1V, 0.2V and the like. In a specific implementation, for the liquid crystal display panel that has been fabricated, the compensation voltage β corresponding to the liquid crystal display panel can be obtained through preliminary debugging. In an embodiment of the present disclosure, a chip corresponding to the source driving circuit generally has an SPI interface and an I2C interface, that is, the chip corresponding to the source driving circuit can communicate with a system motherboard in real time, and then change the voltage (reference voltage) on the liquid crystal display panel by looking up Table 1, which is not limited in time and size and can be adjusted at any time. Therefore, it can also prevent the problem that flicker and yellowing display of a display product as the characteristics of transistors of the liquid crystal display panel change with time.

| β value/v | $1^{st}$ column | $2^{nd}$ column | $3^{rd}$ column | $4^{th}$ column | $5^{th}$ column | $6^{th}$ column | $7^{th}$ column | $8^{th}$ column | $9^{th}$ column | $10^{th}$ column |
|---|---|---|---|---|---|---|---|---|---|---|
| $1^{st}$ row | 0.00 | 0.01 | 0.02 | 0.03 | 0.04 | 0.05 | 0.06 | 0.07 | 0.08 | 0.09 |
| $2^{nd}$ row | 0.10 | 0.11 | 0.12 | 0.13 | 0.14 | 0.15 | 0.16 | 0.17 | 0.18 | 0.19 |
| $3^{rd}$ row | 0.20 | 0.21 | 0.22 | 0.23 | 0.24 | 0.25 | 0.26 | 0.27 | 0.28 | 0.29 |
| $4^{th}$ row | 0.30 | 0.31 | 0.32 | 0.33 | 0.34 | 0.35 | 0.36 | 0.37 | 0.38 | 0.39 |
| $5^{th}$ row | 0.40 | 0.41 | 0.42 | 0.43 | 0.44 | 0.45 | 0.46 | 0.47 | 0.48 | 0.49 |
| $6^{th}$ row | 0.50 | 0.51 | 0.52 | 0.53 | 0.54 | 0.55 | 0.56 | 0.57 | 0.58 | 0.59 |

Figure 5:
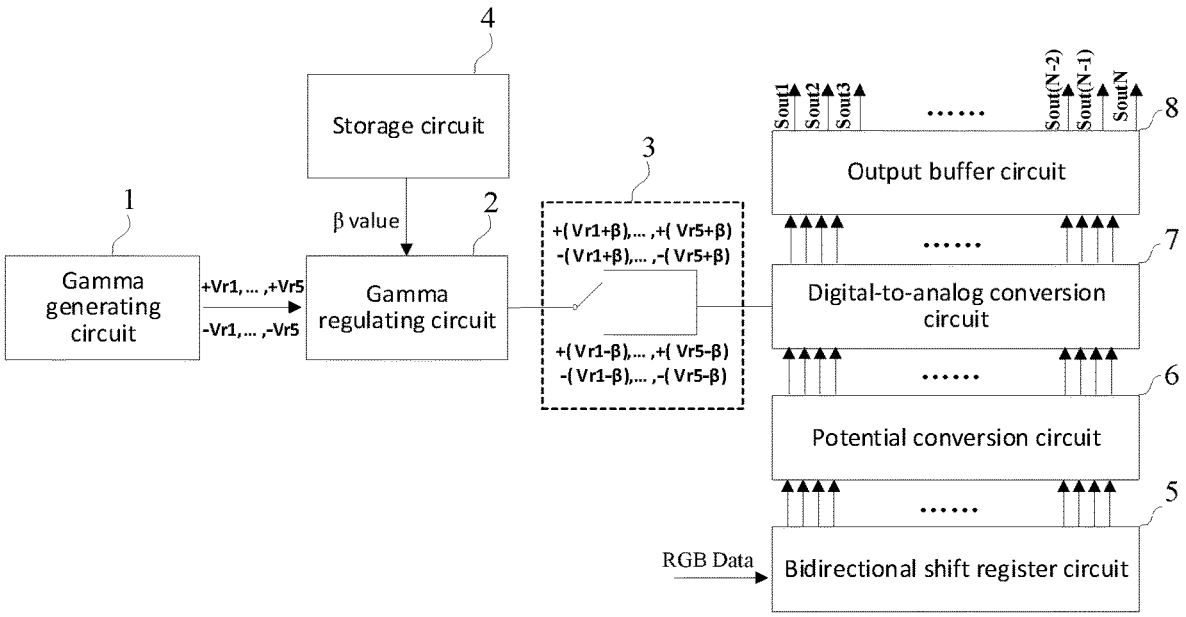
FIG. 5 is a schematic diagram of a driving process of a source driving circuit provided by an embodiment of the present disclosure.

In a specific implementation, as shown in FIG. 5, the source driving circuit further includes: a bidirectional shift register circuit 5, a potential conversion circuit 6, a digital-to-analog conversion circuit 7, and an output buffer circuit 8.

The bidirectional shift register circuit 5 is configured to buffer received video data.

The potential conversion circuit 6 is configured to raise a voltage of the video data according to the video data buffered by the bidirectional shift register circuit.

The digital-to-analog conversion circuit 7 is configured to receive the first output voltage, the second output voltage, the third output voltage, and the fourth output voltage output by the control circuit, and control, according to the raised voltage of the video data, the first output voltage, the second output voltage, the third output voltage, and the fourth output voltage to be output to the output buffer circuit.

The output buffer circuit 8 is configured to generate a plurality of branch voltages according to the first output voltage, the second output voltage, the third output voltage, and the fourth output voltage.

In the embodiment of the present disclosure, the source driving circuit further includes the bidirectional shift register circuit 5, the potential conversion circuit 6, the digital-to-analog conversion circuit 7, and the output buffer circuit 8.

Figure 4:
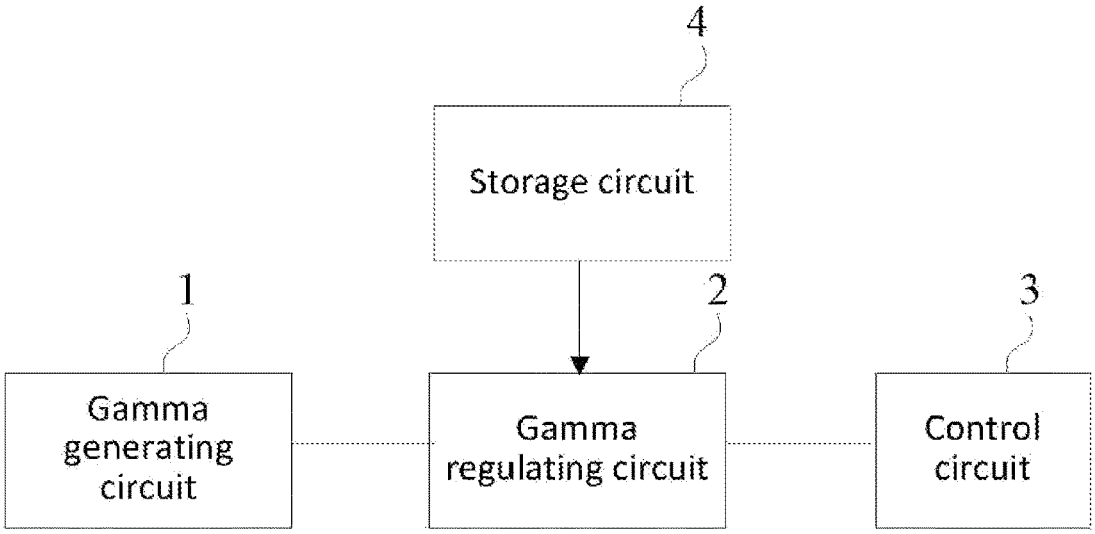
FIG. 4 is a schematic structural diagram of a source driving circuit including a storage circuit provided by an embodiment of the present disclosure.

In conjunction with that shown in FIG. 4, the video data (may include RGB data) is first buffered by the bidirectional shift register circuit 5, and then input to the potential conversion circuit 6 to raise the voltage of the video signal. The voltage of the raised video data turns on the gate of a corresponding MOS transistor in the digital-to-analog conversion circuit 7. Subsequently, the gamma generating circuit 1 generates the plurality of gamma reference voltage pairs (+Vr1, . . . , +Vr5 and −Vr1, . . . , −Vr5) and input the same to the gamma regulating circuit 2, and the gamma regulating circuit 2 adjusts the gamma reference voltage according to the compensation voltage β, and then transmits the adjusted first output voltage +(Vr1+β), . . . , +(Vr5+β), second output voltage −(Vr1+β), . . . , −(Vr5+β), third output voltage +(Vr1−β), . . . , +(Vr5−β), fourth output voltage −(Vr1−β), . . . , −(Vr5−β) respectively to the digital-to-analog conversion circuit 7, and then to the output buffer circuit 8 through the MOS transistor, and data (source) signal is transmitted to data lines (source lines) in the display panel according to signals of a gate driving circuit, and finally the pixel is driven to display normally.

In a specific implementation, the control circuit 3 in an embodiment of the present disclosure may be an independent circuit structure, or may be a structure integrated in the gamma regulating circuit 2 or the digital-to-analog conversion circuit 7 or other circuits.

Figure 6:
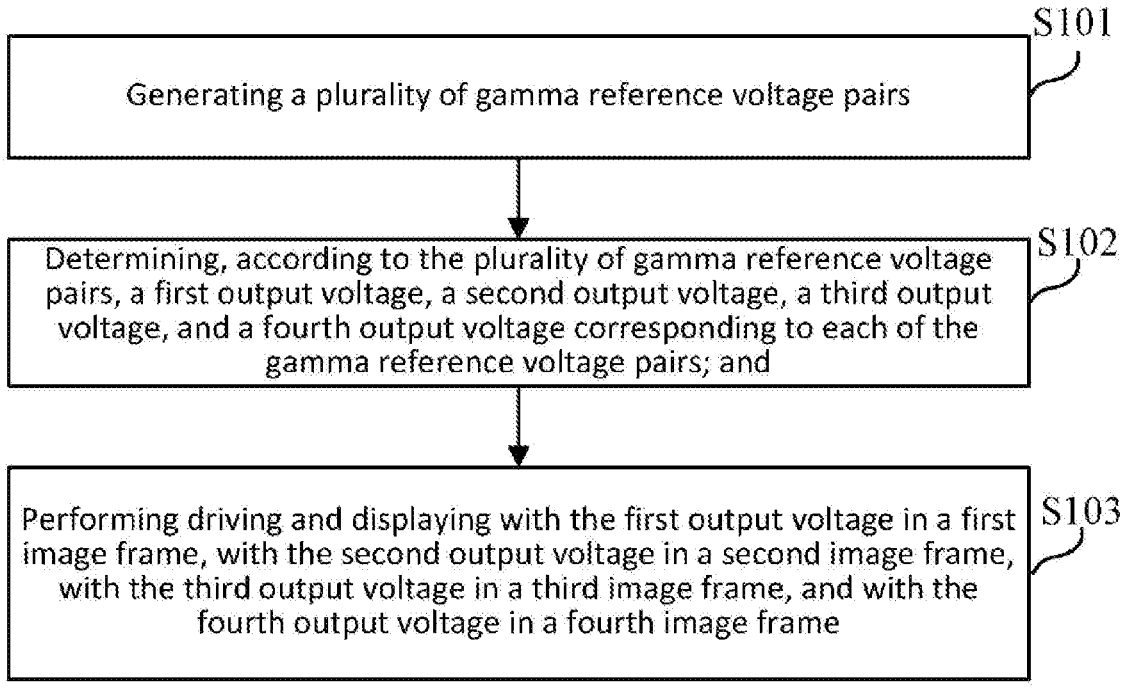
FIG. 6 is a schematic flowchart of a driving method of a source driving circuit provided by an embodiment of the present disclosure.

Based on the same inventive concept, referring to FIG. 6, an embodiment of the present disclosure also provides a driving method of a driving circuit, including the following steps.

In step S101, a plurality of gamma reference voltage pairs are generated.

In step S102, a first output voltage, a second output voltage, a third output voltage, and a fourth output voltage corresponding to each of the gamma reference voltage pairs are determined according to the plurality of gamma reference voltage pairs and a compensation voltage. Specifically, the step S102 of determining, according to the plurality of gamma reference voltage pairs and the compensation voltage, the first output voltage, the second output voltage, the third output voltage, and the fourth output voltage corresponding to each of the gamma reference voltage pairs includes: step S1021, acquiring, according to the gamma reference voltage pairs, the compensation voltage which is pre-stored; and step S1022, determining, according to the gamma reference voltage pairs and the compensation voltage, the first output voltage, the second output voltage, the third output voltage, and the fourth output voltage corresponding to each of the gamma reference voltage pairs.

In step S103, driving and displaying are performed with the first output voltage in a first image frame, with the second output voltage in a second image frame, with the third output voltage in a third image frame, and with the fourth output voltage in a fourth image frame.

In a specific implementation, before the step S102, that is, before determining the first output voltage, the second output voltage, the third output voltage, and the fourth output voltage, the driving method further includes: storing the compensation voltage.

Figure 7:
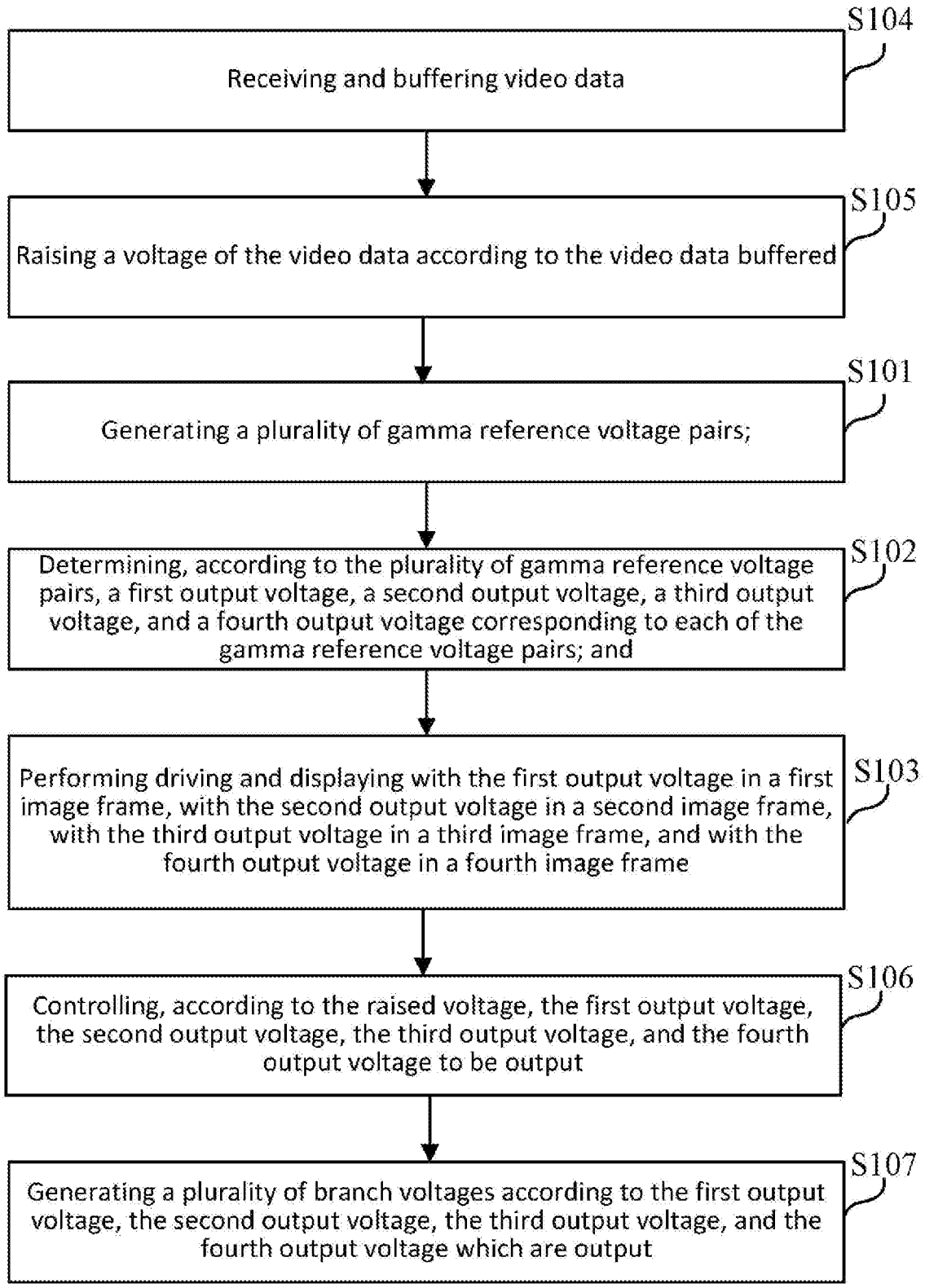
FIG. 7 is a schematic flowchart of a specific driving method of a source driving circuit provided by an embodiment of the present disclosure.

In a specific implementation, referring to FIG. 7, before step S102, that is, before determining the first output voltage, the second output voltage, the third output voltage, and the fourth output voltage corresponding to each of the gamma reference voltage pairs, the driving method further includes:

step S104, receiving and buffering video data; and step S105, raising a voltage of the video data according to the video data buffered.

After step S102, that is, after determining the first output voltage, the second output voltage, the third output voltage, and the fourth output voltage corresponding to each of the gamma reference voltage pairs, the driving method further includes:

step S106, controlling, according to the raised voltage of the video data, the first output voltage, the second output voltage, the third output voltage, and the fourth output voltage to be output; and step S107, generating a plurality of branch voltages according to the first output voltage, the second output voltage, the third output voltage, and the fourth output voltage which are output.

Based on the same inventive concept, an embodiment of the present disclosure further provides a display device, including the source driving circuit provided in the embodiment of the present disclosure.

The embodiments of the present disclosure have the following beneficial effects:

The source driving circuit provided by the embodiment of the present disclosure includes the gamma generating circuit, the gamma regulating circuit, and the control circuit. The gamma regulating circuit is configured to determine, according to the plurality of gamma reference voltage pairs, the first output voltage, the second output voltage, the third output voltage, and the fourth output voltage corresponding to each of the gamma reference voltage pairs; and the control circuit is configured to perform driving and displaying with the first output voltage in the first image frame, with the second output voltage in the second image frame, with the third output voltage in the third image frame, and with the fourth output voltage in the fourth image frame. That is, in the embodiment of the present disclosure, during the first image frame and the second image frame, the compensation voltage is added to the absolute values of the positive gamma reference voltage and the negative gamma reference voltage respectively, that is, a driving is performed with +(Vr+β) and −(Vr+β), and a corresponding brightness curve during this time period is closer to a corresponding brightness curve in a large viewing angle. During the third image frame and the fourth image frame, the compensation voltage is subtracted from the absolute values of the positive gamma reference voltage and the negative gamma reference voltage respectively, that is, the driving is respectively performed with +(Vr−β) and −(Vr−β), and a corresponding brightness curve during this time period is closer to a corresponding brightness curve in a vertical viewing angle. During a continuous viewing process, since there is a vision persistence effect of human eyes, what the human eyes see is a neutralized curve, that is, the brightness curve actually viewed is closer to an ideal curve, which can decrease a color shift in a large viewing angle. Further, compared with the related art in which different pixel circuits are used to decrease the color shift in the large viewing angle, the source drive circuit provided by the embodiment of the present disclosure has a less complicated pixel driving circuit, which can overcome the problem that the complexity of the pixel control circuit is increased for decreasing the color shift in the large viewing angle in the related art, and thus can reduce a aperture ratio of pixel.

Understandably, those skilled in the art can make various changes and modifications to the present disclosure without departing from the spirit and scope of the present disclosure. In this way, if these modifications and variations of the present disclosure fall within the scope of the claims of the present disclosure and equivalent technologies thereof, the present disclosure also intends to include these modifications and variations.

What is claimed is:

1. A source driving circuit, comprising:

a gamma generating circuit, a gamma regulating circuit, and a control circuit, wherein:

the gamma generating circuit is configured to generate a plurality of gamma reference voltage pairs;

the gamma regulating circuit is configured to determine, according to the plurality of gamma reference voltage pairs and a compensation voltage, a first output voltage, a second output voltage, a third output voltage, and a fourth output voltage corresponding to each of the gamma reference voltage pairs;

the control circuit is configured to perform driving and displaying with the first output voltage in a first image frame, with the second output voltage in a second image frame, with the third output voltage in a third image frame, and with the fourth output voltage in a fourth image frame;

the gamma regulating circuit is further configured to acquire, according to the gamma reference voltage pairs, the compensation voltage which is pre-stored, and determine, according to the gamma reference voltage pairs and the compensation voltage, the first output voltage, the second output voltage, the third output voltage, and the fourth output voltage corresponding to each of the gamma reference voltage pairs; and the first output voltage is equal to a sum of the positive gamma reference voltage and the compensation voltage, the second output voltage is equal to a difference between the negative gamma reference voltage and the compensation voltage, the third output voltage is equal to a difference of the positive gamma reference voltage and the compensation voltage, and the fourth output voltage is equal to a sum of the negative gamma reference voltage and the compensation voltage.

2. The source driving circuit according to claim 1, wherein:

the source driving circuit further comprises a storage circuit; and the storage circuit is configured to store the compensation voltage before the gamma regulating circuit determines the first output voltage, the second output voltage, the third output voltage, and the fourth output voltage.

3. The source driving circuit according to claim 2, wherein the compensation voltage is 0 V to 0.2 V.

4. The source driving circuit according to claim 1, wherein the source driving circuit further comprises:

a bidirectional shift register circuit, a potential conversion circuit, a digital-to-analog conversion circuit, and an output buffer circuit, wherein:

the bidirectional shift register circuit is configured to buffer received video data;

the potential conversion circuit is configured to raise a voltage of the video data according to the video data buffered by the bidirectional shift register circuit;

the digital-to-analog conversion circuit is configured to receive the first output voltage, the second output voltage, the third output voltage, and the fourth output voltage output by the control circuit, and control, according to the raised voltage of the video data, the first output voltage, the second output voltage, the third output voltage, and the fourth output voltage to be output to the output buffer circuit; and the output buffer circuit is configured to generate a plurality of branch voltages according to the first output voltage, the second output voltage, the third output voltage, and the fourth output voltage.

5. The source driving circuit according to claim 1, wherein each of the gamma reference voltage pairs comprises a positive gamma reference voltage and a negative gamma reference voltage having equal absolute values.

6. The source driving circuit according to claim 1, wherein the first image frame, the second image frame, the third image frame, and the fourth image frame are four adjacent image frames in a display process.

7. A driving method of a source driving circuit, comprising:

generating a plurality of gamma reference voltage pairs;

determining, according to the plurality of gamma reference voltage pairs and a compensation voltage, a first output voltage, a second output voltage, a third output voltage, and a fourth output voltage corresponding to each of the gamma reference voltage pairs by:

acquiring, according to the gamma reference voltage pairs, the compensation voltage that is pre-stored; and determining, according to the gamma reference voltage pairs and the compensation voltage, the first output voltage, the second output voltage, the third output voltage, and the fourth output voltage corresponding to each of the gamma reference voltage pairs; and performing driving and displaying with the first output voltage in a first image frame, with the second output voltage in a second image frame, with the third output voltage in a third image frame, and with the fourth output voltage in a fourth image frame.

8. The driving method according to claim 7, wherein the driving method further comprises, before determining the first output voltage, the second output voltage, the third output voltage, and the fourth output voltage, storing the compensation voltage.

9. The driving method according claim 7, wherein the driving method further comprises, before determining the first output voltage, the second output voltage, the third output voltage, and the fourth output voltage corresponding to each of the gamma reference voltage pairs:

receiving and buffering video data; and raising a voltage of the video data according to the video data buffered, and wherein the driving method further comprises, before determining the first output voltage, the second output voltage, the third output voltage, and the fourth output voltage corresponding to each of the gamma reference voltage pairs:

controlling, according to the raised voltage of the video data, the first output voltage, the second output voltage, the third output voltage, and the fourth output voltage to be output; and generating a plurality of branch voltages according to the first output voltage, the second output voltage, the third output voltage, and the fourth output voltage which are output.

10. The driving method according to claim 7, wherein each of the gamma reference voltage pairs comprises a positive gamma reference voltage and a negative gamma reference voltage having equal absolute values.

11. The driving method according to claim 7, wherein the first image frame, the second image frame, the third image frame, and the fourth image frame are four adjacent image frames in a display process.

12. A display device, comprising:

a source driving circuit having a gamma generating circuit, a gamma regulating circuit, and a control circuit, wherein:

the gamma generating circuit is configured to generate a plurality of gamma reference voltage pairs;

the gamma regulating circuit is configured to determine, according to the plurality of gamma reference voltage pairs and a compensation voltage, a first output voltage, a second output voltage, a third output voltage, and a fourth output voltage corresponding to each of the gamma reference voltage pairs;

the control circuit is configured to perform driving and displaying with the first output voltage in a first image frame, with the second output voltage in a second image frame, with the third output voltage in a third image frame, and with the fourth output voltage in a fourth image frame;

the gamma regulating circuit is configured to acquire, according to the gamma reference voltage pairs, the compensation voltage which is pre-stored, and determine, according to the gamma reference voltage pairs and the compensation voltage, the first output voltage, the second output voltage, the third output voltage, and the fourth output voltage corresponding to each of the gamma reference voltage pairs; and the first output voltage is equal to a sum of the positive gamma reference voltage and the compensation voltage, the second output voltage is equal to a difference between the negative gamma reference voltage and the compensation voltage, the third output voltage is equal to a difference of the positive gamma reference voltage and the compensation voltage, and the fourth output voltage is equal to a sum of the negative gamma reference voltage and the compensation voltage.

13. The display device according to claim 12, wherein:

the source driving circuit further comprises a storage circuit, and the storage circuit is configured to store the compensation voltage before the gamma regulating circuit determines the first output voltage, the second output voltage, the third output voltage, and the fourth output voltage.

14. The display device according to claim 13, wherein the compensation voltage is 0 V to 0.2 V.

15. The display device according to claim 12, wherein the source driving circuit further comprises:

a bidirectional shift register circuit, a potential conversion circuit, a digital-to-analog conversion circuit, and an output buffer circuit, wherein:

the bidirectional shift register circuit is configured to buffer received video data;

the potential conversion circuit is configured to raise a voltage of the video data according to the video data buffered by the bidirectional shift register circuit;

the digital-to-analog conversion circuit is configured to receive the first output voltage, the second output voltage, the third output voltage, and the fourth output voltage output by the control circuit, and control, according to the raised voltage of the video data, the first output voltage, the second output voltage, the third output voltage, and the fourth output voltage to be output to the output buffer circuit; and the output buffer circuit is configured to generate a plurality of branch voltages according to the first output voltage, the second output voltage, the third output voltage, and the fourth output voltage.

16. The display device according to claim 12, wherein each of the gamma reference voltage pairs comprises a positive gamma reference voltage and a negative gamma reference voltage having equal absolute values.

17. The display device according to claim 12, wherein the first image frame, the second image frame, the third image frame, and the fourth image frame are four adjacent image frames in a display process.

* * * * *